US005996441A

United States Patent [19]

Bateman

[11] Patent Number: 5,996,441

[45] Date of Patent: Dec. 7, 1999

[54] ADJUSTABLE ELECTRIC BOTTLE OPENER

[76] Inventor: Merlin L. Bateman, 14145 S. 2200 West, Bluffdale, Utah 84065

[21] Appl. No.: 09/113,001

[22] Filed: Jul. 9, 1998

[51] Int. Cl.[6] ..... B67B 7/18

[52] U.S. Cl. ..... 81/3.2; 81/3.25

[58] Field of Search ..... 81/3.2, 3.25, 3.31, 81/3.32, 3.39

[56] References Cited

U.S. PATENT DOCUMENTS

| | | | |
|---|---|---|---|
| 1,689,301 | 10/1928 | Ryckman | 81/3.32 X |
| 2,644,354 | 7/1953 | Schlageter | 81/3.25 |
| 4,519,276 | 5/1985 | Grabarski et al. | 81/3.2 |
| 5,003,844 | 4/1991 | Barrow | 81/3.2 |
| 5,329,831 | 7/1994 | Pierce, Jr. et al. | 81/3.2 X |
| 5,345,844 | 9/1994 | Marsaw | 81/3.2 |
| 5,353,665 | 10/1994 | Heebner | 81/3.2 |
| 5,370,019 | 12/1994 | Sartell et al. | 81/3.2 X |

*Primary Examiner*—David A. Scherbel
*Assistant Examiner*—Anthony Ojini

[57] ABSTRACT

A new adjustable electric bottle opener for quickly and easily opening vacuum packed jars and oversized bottles. The inventive device includes a base member having a C-shaped support bracket secured to an upper surface thereof. The C-shaped support bracket is dimensioned for receiving a base of a bottle therein. The base member includes a collar extending upwardly from the upper surface thereof. An upper housing is adjustably coupled with respect to the base member. The upper housing has a support arm extending downwardly therefrom. The support arm is slidably received within the collar of the base member. A motor is disposed interiorly of the upper housing. The motor has a rotating axle extending outwardly thereof. The axle has a beveled gear disposed on a free end thereof. The beveled gear couples with a beveled drive gear within the upper housing. The drive gear has a shaft extending outwardly of the lower surface of the housing. The shaft has a circular plate secured thereto upwardly of an outer end thereof. The outer end of the shaft has a drive cam disposed thereon. Opposing ends of the drive cam have brackets pivotally coupled thereto. Free ends of the brackets each have an arcuate gripping member secured thereto. The arcuate gripping members engage a top of the bottle therebetween to facilitate removal thereof.

5 Claims, 2 Drawing Sheets

ADJUSTABLE ELECTRIC BOTTLE OPENER

BACKGROUND OF THE INVENTION

1. Field of the Invention

The present invention relates to bottle openers and more particularly pertains to a new adjustable electric bottle opener for quickly and easily opening vacuum packed jars and oversized bottles.

2. Description of the Prior Art

The use of bottle openers is known in the prior art. More specifically, bottle openers heretofore devised and utilized are known to consist basically of familiar, expected and obvious structural configurations, notwithstanding the myriad of designs encompassed by the crowded prior art which have been developed for the fulfillment of countless objectives and requirements.

Known prior art bottle openers include U.S. Pat. No. 5,313,857 to Weisband; U.S. Pat. No. 5,329,831 to Pierce, Jr. et al.; U.S. Pat. No. 4,615,241 to Grabarski et al.; U.S. Pat. No. 4,334,332 to Downs; U.S. Pat. No. 4,154,127 to Russo; and U.S. Pat. No. Des. 303,343 to Nuss.

While these devices fulfill their respective, particular objectives and requirements, the aforementioned patents do not disclose a new adjustable electric bottle opener. The inventive device includes a base member having a C-shaped support bracket secured to an upper surface thereof. The C-shaped support bracket is dimensioned for receiving a base of a bottle therein. The base member includes a collar extending upwardly from the upper surface thereof. An upper housing is adjustably coupled with respect to the base member. The upper housing has a support arm extending downwardly therefrom. The support arm is slidably received within the collar of the base member. A motor is disposed interiorly of the upper housing. The motor has a rotating axle extending outwardly thereof. The axle has a beveled gear disposed on a free end thereof. The beveled gear couples with a beveled drive gear within the upper housing. The drive gear has a shaft extending outwardly of the lower surface of the housing. The shaft has a circular plate secured thereto upwardly of an outer end thereof. The outer end of the shaft has a drive cam disposed thereon. Opposing ends of the drive cam have brackets pivotally coupled thereto. Free ends of the brackets each have an arcuate gripping member secured thereto. The arcuate gripping members engage a top of the bottle therebetween to facilitate removal thereof.

In these respects, the adjustable electric bottle opener according to the present invention substantially departs from the conventional concepts and designs of the prior art, and in so doing provides an apparatus primarily developed for the purpose of quickly and easily opening vacuum packed jars and oversized bottles.

SUMMARY OF THE INVENTION

In view of the foregoing disadvantages inherent in the known types of bottle openers now present in the prior art, the present invention provides a new adjustable electric bottle opener construction wherein the same can be utilized for quickly and easily opening vacuum packed jars and oversized bottles.

The general purpose of the present invention, which will be described subsequently in greater detail, is to provide a new adjustable electric bottle opener apparatus and method which has many of the advantages of the bottle openers mentioned heretofore and many novel features that result in a new adjustable electric bottle opener which is not anticipated, rendered obvious, suggested, or even implied by any of the prior art bottle openers, either alone or in any combination thereof.

To attain this, the present invention generally comprises a base member having generally planar upper and lower surfaces. The base member includes an arcuate outer end and a linear inner end. The base member includes a C-shaped support bracket secured to the upper surface thereof inwardly of the arcuate outer end. The C-shaped support bracket is dimensioned for receiving a base of a bottle therein. The base member includes a collar extending upwardly from an upper surface thereof inwardly of the linear inner end. The collar has a square cross-section. The collar has a screw extending inwardly of a side wall thereof. An upper housing is adjustably coupled with respect to the base member. The upper housing has a domed upper surface, a planar lower surface, an arcuate outer end, and a linear inner end. The lower surface has a support arm extending downwardly therefrom inwardly of the linear inner end. The support arm is slidably received within the collar of the base member. The support arm has an elongated vertically disposed slot formed therein. The slot engages the screw of the collar whereby tightening of the screw will fix a height of the support arm of the upper housing. A motor is disposed interiorly of the upper housing. The motor has a power switch extending outwardly of the upper housing. The motor has a rotating axle extending outwardly thereof. The axle has a beveled gear disposed on a free end thereof. The beveled gear couples with a beveled drive gear within the upper housing. The drive gear has a shaft extending outwardly of the lower surface of the housing. The shaft has a circular plate secured thereto upwardly of an outer end thereof. The outer end of the shaft has a drive cam disposed thereon. Opposing ends of the drive cam have brackets pivotally coupled thereto. Free ends of the brackets each have an arcuate gripping member secured thereto. The arcuate gripping members engage a top of the bottle therebetween to facilitate removal thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable electric bottle opener apparatus and method which has many of the advantages of the bottle openers mentioned heretofore and many novel features that result in a new adjustable electric bottle opener which is not anticipated, rendered obvious, suggested, or even implied by any of the prior art bottle openers, either alone or in any combination thereof.

It is another object of the present invention to provide a new adjustable electric bottle opener which may be easily and efficiently manufactured and marketed.

It is a further object of the present invention to provide a new adjustable electric bottle opener which is of a durable and reliable construction.

An even further object of the present invention is to provide a new adjustable electric bottle opener which is susceptible of a low cost of manufacture with regard to both materials and labor, and which accordingly is then susceptible of low prices of sale to the consuming public, thereby making such adjustable electric bottle opener economically available to the buying public.

Still yet another object of the present invention is to provide a new adjustable electric bottle opener which provides in the apparatuses and methods of the prior art some of the advantages thereof, while simultaneously overcoming some of the disadvantages normally associated therewith.

Still another object of the present invention is to provide a new adjustable electric bottle opener for quickly and easily opening vacuum packed jars and oversized bottles.

Yet another object of the present invention is to provide a new adjustable electric bottle opener which includes a base member having a C-shaped support bracket secured to an upper surface thereof. The C-shaped support bracket is dimensioned for receiving a base of a bottle therein. The base member includes a collar extending upwardly from the upper surface thereof. An upper housing is adjustably coupled with respect to the base member. The upper housing has a support arm extending downwardly therefrom. The support arm is slidably received within the collar of the base member. A motor is disposed interiorly of the upper housing. The motor has a rotating axle extending outwardly thereof. The axle has a beveled gear disposed on a free end thereof. The beveled gear couples with a beveled drive gear within the upper housing. The drive gear has a shaft extending outwardly of the lower surface of the housing. The shaft has a circular plate secured thereto upwardly of an outer end thereof. The outer end of the shaft has a drive cam disposed thereon. Opposing ends of the drive cam have brackets pivotally coupled thereto. Free ends of the brackets each have an arcuate gripping member secured thereto. The arcuate gripping members engage a top of the bottle therebetween to facilitate removal thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
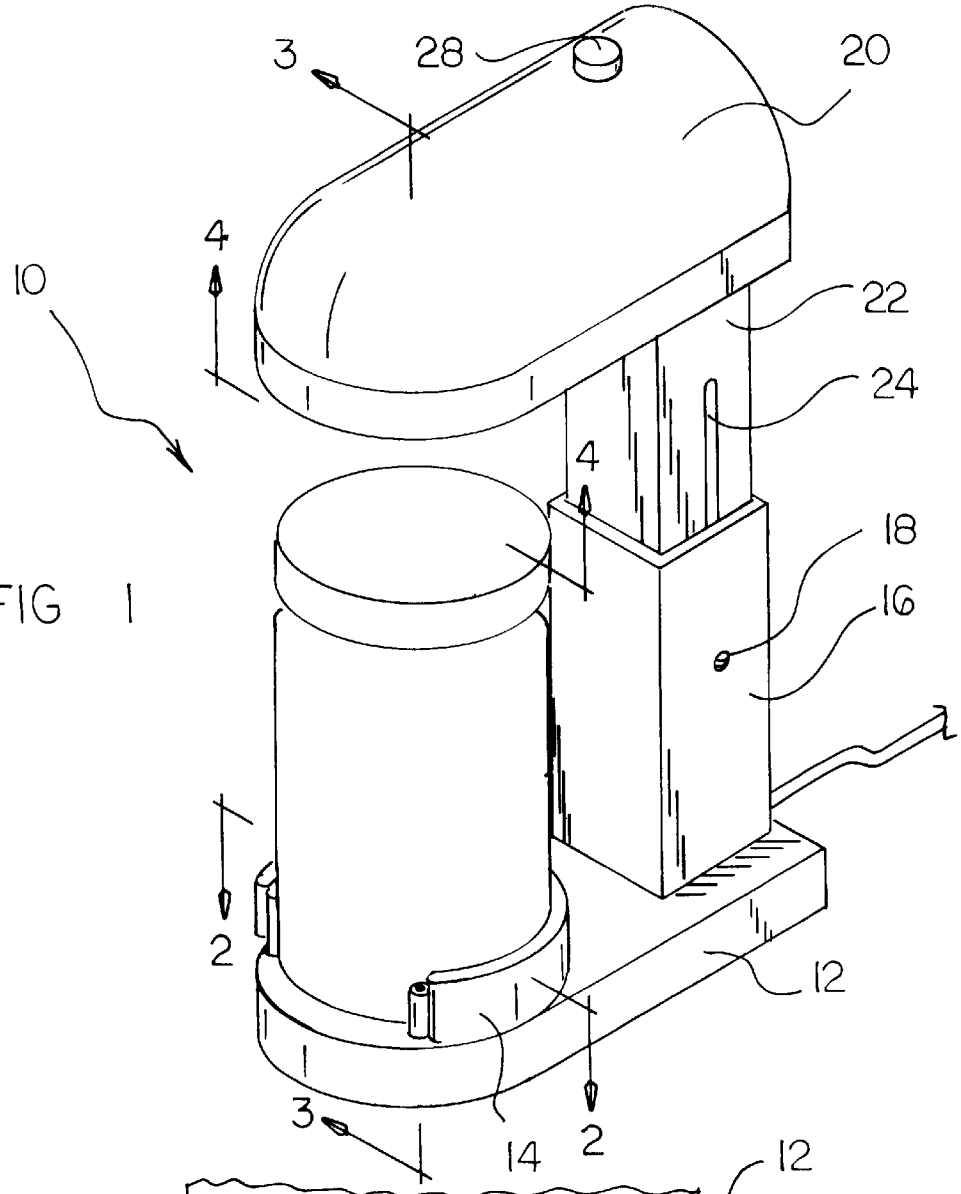
FIG. 1 is a perspective view of a new adjustable electric bottle opener according to the present invention.
Figure 2:
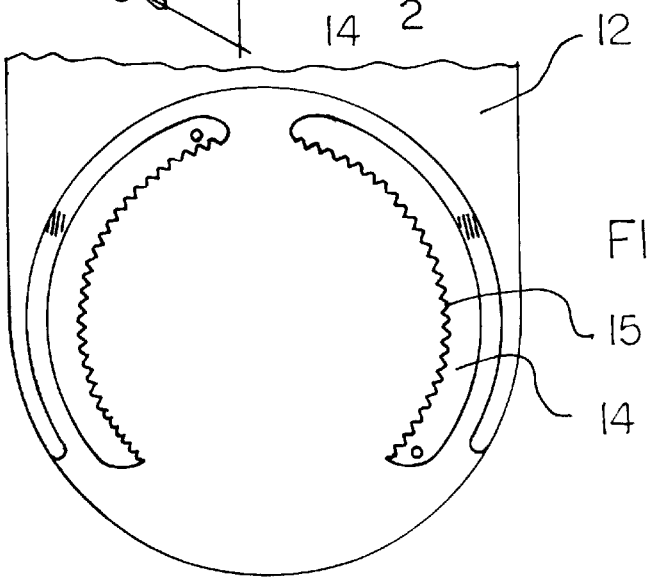
FIG. 2 is a cross-sectional view of the present invention as taken along line 2—2 of FIG. 1.
Figure 3:
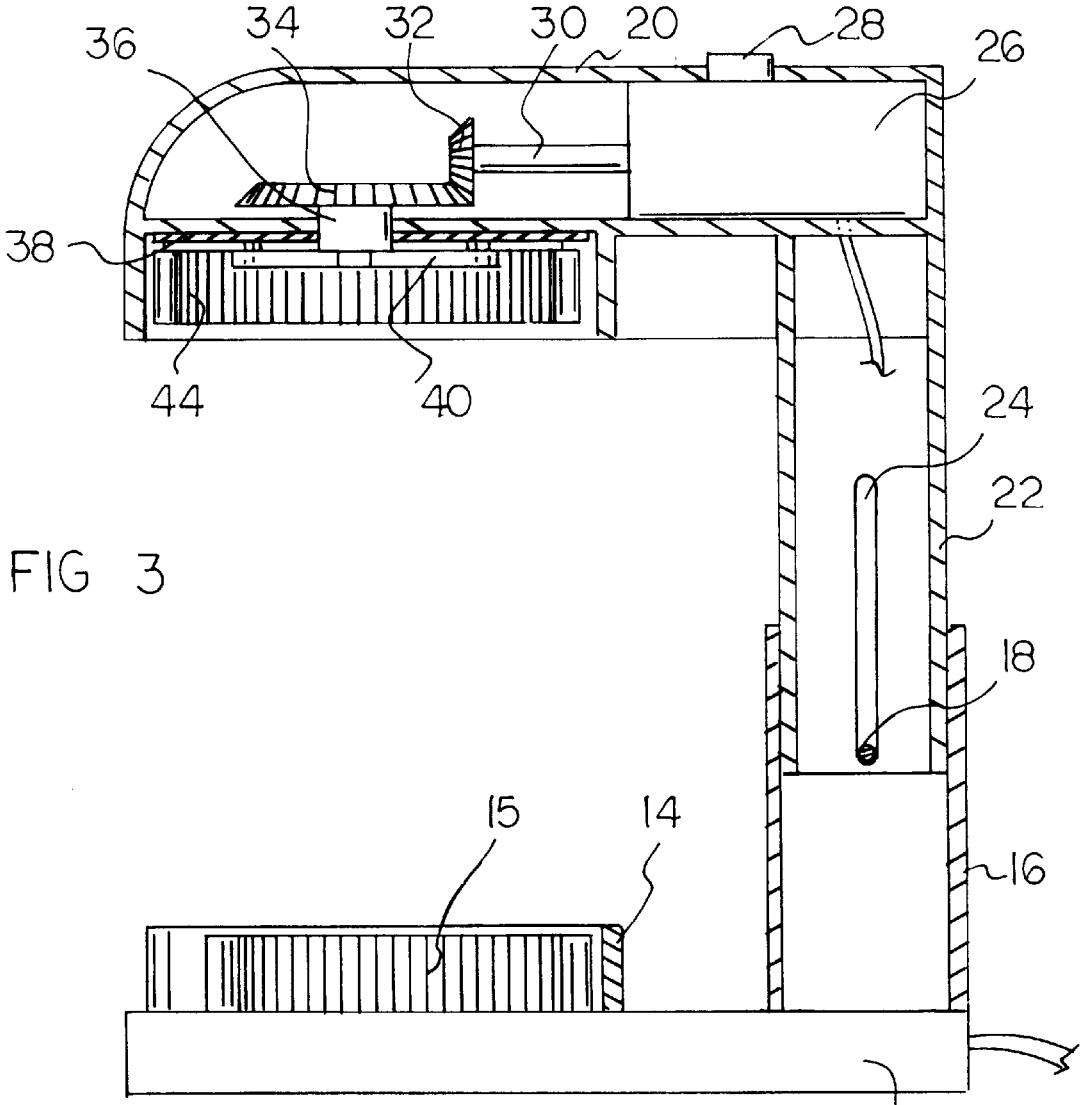
FIG. 3 is a cross-sectional view of the present invention as taken along line 3—3 of FIG. 1.
Figure 4:
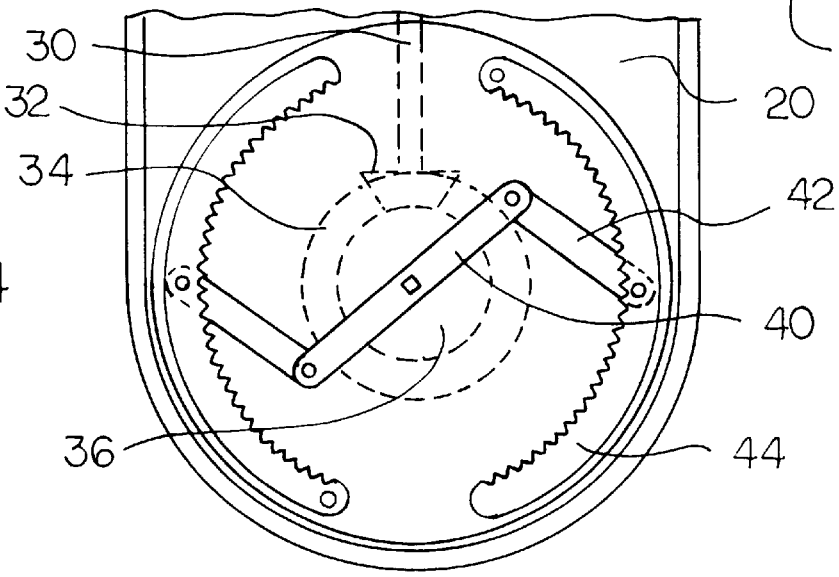
FIG. 4 is a cross-sectional view of the present invention as taken along line 4—4 of FIG. 1.

With reference now to the drawings, and in particular to FIGS. 1 through 4 thereof, a new adjustable electric bottle opener embodying the principles and concepts of the present invention and generally designated by the reference numeral 10 will be described.

As best illustrated in FIGS. 1 through 4, the adjustable electric bottle opener 10 comprises a base member 12 having generally planar upper and lower surfaces. The base member 12 includes an arcuate outer end and a linear inner end. The base member 12 includes a C-shaped support bracket 14 secured to the upper surface thereof inwardly of the arcuate outer end. The support bracket 14 is provided with serrated teeth 15 on an interior surface thereof. The C-shaped support bracket 14 is dimensioned for receiving a base of a bottle therein. The base member 12 includes a collar 16 extending upwardly from an upper surface thereof inwardly of the linear inner end. The collar 16 has a square cross-section. The collar 16 has a screw 18 extending inwardly of a side wall thereof.

An upper housing 20 is adjustably coupled with respect to the base member 12. The upper housing 20 has a domed upper surface, a planar lower surface, an arcuate outer end, and a linear inner end. The lower surface has a support arm 22 extending downwardly therefrom inwardly of the linear inner end. The support arm 22 is slidably received within the collar 16 of the base member 12. The support arm 22 has an elongated vertically disposed slot 24 formed therein. The slot 24 engages the screw 18 of the collar 16 whereby tightening of the screw 18 will couple the upper housing 20 to the base member 12.

A motor 26 is disposed interiorly of the upper housing 20. The motor 26 has a power switch 28 extending outwardly of the upper housing 20. The motor 26 has a rotating axle 30 extending outwardly thereof. The axle 30 has a beveled gear 32 disposed on a free end thereof. The beveled gear 32 couples with a beveled drive gear 34 within the upper housing 20. The drive gear 34 has a shaft 36 extending outwardly of the lower surface of the housing 20. The shaft 36 has a circular plate 38 secured thereto upwardly of an outer end thereof. The outer end of the shaft 36 has a drive cam 40 disposed thereon. Opposing ends of the drive cam 40 have brackets 42 pivotally coupled thereto. Free ends of the brackets 42 each have an arcuate gripping member 44 secured thereto. The arcuate gripping members 44 pivot to engage a top of the bottle therebetween to facilitate removal thereof.

In use, a person would place a bottle or jar within the C-shaped bracket 14 and then raise or lower the upper housing 20 to properly fit the bottle or jar. The support arm 22 rest upon a spring within the collar of the base member 16. The height is set by pushing down on the upper housing 20 against an urging of the spring. The power switch 28 is then pressed to activate the motor 26. This can all be achieved with a single hand. The motor will cause the rotating axle 30 to spin thereby moving the beveled gear 32 and the beveled drive gear 34. The shaft 36 will also rotate causing movement of the drive cam 40. The movement of the drive cam 40 will result in the inward movement of the brackets 42 and arcuate gripping members 44 to grasp the top to the bottle or jar. Once a tight grip is achieved, the circular plate 38 will rotate to remove the top.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new adjustable electric bottle opener for quickly and easily opening vacuum packed jars and oversized bottles comprising, in combination:

a base member having generally planar upper and lower surfaces, the base member including an arcuate outer end and a linear inner end, the base member including a C-shaped support bracket secured to the upper surface thereof inwardly of the arcuate outer end, the C-shaped support bracket being dimensioned for receiving a base of a bottle therein, the base member including a collar extending upwardly from an upper surface thereof inwardly of the linear inner end, the collar having a square cross-section, the collar having a screw extending inwardly of a side wall thereof;

an upper housing adjustably coupled with respect to the base member, the upper housing having a domed upper surface, a planar lower surface, an arcuate outer end, and a linear inner end, the lower surface having a support arm extending downwardly therefrom inwardly of the linear inner end, the support arm being slidably received within the collar of the base member, the support arm having an elongated vertically disposed slot formed therein, the slot sliding along the screw of the collar;

a motor disposed interiorly of the upper housing, the motor having a power switch extending outwardly of the upper housing, the motor having a rotating axle extending outwardly thereof, the axle having a beveled gear disposed on a free end thereof, the beveled gear coupling with a beveled drive gear within the upper housing, the drive gear having a shaft extending outwardly of the lower surface of the housing, the shaft having a circular plate secured thereto upwardly of an outer end thereof, the outer end of the shaft having a drive cam disposed thereon, opposing ends of the drive cam having brackets pivotally coupled thereto, free ends of the brackets each having an arcuate gripping member secured thereto, the arcuate gripping members engaging a top of the bottle therebetween to facilitate removal thereof.

2. A new adjustable electric bottle opener for quickly and easily opening vacuum packed jars and oversized bottles comprising, in combination:

a base member having a C-shaped support bracket secured to an upper surface thereof, the C-shaped support bracket being dimensioned for receiving a base of a bottle therein, the base member including a collar extending upwardly from an upper surface;

an upper housing adjustably coupled with respect to the base member, the upper housing having a support arm extending downwardly therefrom, the support arm being slidably received within the collar of the base member;

a motor disposed interiorly of the upper housing, the motor having a rotating axle extending outwardly thereof, the axle having a beveled gear disposed on a free end thereof, the beveled gear coupling with a beveled drive gear within the upper housing, the drive gear having a shaft extending outwardly of the lower surface of the housing, the shaft having a circular plate secured thereto upwardly of an outer end thereof, the outer end of the shaft having a drive cam disposed thereon, opposing ends of the drive cam having brackets pivotally coupled thereto, free ends of the brackets each having an arcuate gripping member secured thereto, the arcuate gripping members engaging a top of the bottle therebetween to facilitate removal thereof.

3. The adjustable electric bottle opener as set forth in claim 2 wherein the collar has a screw extending inwardly of a side wall thereof for engaging the support arm of the upper housing to fix a height thereof.

4. The adjustable electric bottle opener as set forth in claim 3 wherein the support arm having an elongated vertically disposed slot formed therein, the slot receives the screw of the collar to facilitate sliding of the support arm with respect to the collar.

5. The adjustable electric bottle opener as set forth in claim 2 wherein the motor has a power switch extending outwardly of the upper housing.

* * * * *